US005662863A

United States Patent [19]

Okamoto et al.

[11] Patent Number: 5,662,863

[45] Date of Patent: Sep. 2, 1997

[54] PROCESS FOR PRODUCING STRUCTURAL MEMBER OF ALUMINUM ALLOY

[75] Inventors: Kenji Okamoto; Hiroyuki Horimura; Masahiko Minemi, all of Saitama, Japan

[73] Assignee: Honda Giken Kogyo Kabushiki Kaisha, Tokyo, Japan

[21] Appl. No.: 516,583

[22] Filed: Aug. 18, 1995

[30] Foreign Application Priority Data

Aug. 19, 1994 [JP] Japan ..... 6-195783

[51] Int. Cl.[6] ..... B22F 1/00

[52] U.S. Cl. ..... 419/44

[58] Field of Search ..... 419/44, 48

[56] References Cited

U.S. PATENT DOCUMENTS 5,022,918 6/1991 Koike et al. .
5,145,503 9/1992 Horimura .
5,340,659 8/1994 Horimura .
5,360,463 11/1994 Horimura .
5,498,393 3/1996 Horimura et al. .

FOREIGN PATENT DOCUMENTS 5279767 10/1993 Japan .

*Primary Examiner*—Charles T. Jordan
*Assistant Examiner*—Anthony R. Chi
*Attorney, Agent, or Firm*—Lyon & Lyon LLP

[57] ABSTRACT

A powder preform of aluminum alloy powder is subjected to a heating treatment and then to a compacting and hardening process under a pressure to produce a structural member of aluminum alloy. The aluminum alloy powder used is one having a non-equilibrium phase which shows a calorific value C in a range of $C \geqq 10$ J/g at a temperature-increasing rate of 20 K./min in a differential scanning calorimetry. In the heating treatment, the average temperature-rising rate $R_2$ from a heat-generation starting temperature Tx (K.) of the aluminum alloy powder to Tx+A (wherein $A \geqq 30$ K.) is $R_2 \leqq 60$ K./min. Thus, the change of the non-equilibrium phase in the powder preform is uniformly performed. In addition, the average temperature-increasing rate $R_4$ from a processing temperature Tw (K.–B) in the compacting and hardening process to Tw (wherein $B \geqq 30$ K., and Tw–B>Tx+A) is $R_4 \geqq 60$ K./min. Thus, the oxidation of the powder preform is reliably prevented.

5 Claims, 3 Drawing Sheets

PROCESS FOR PRODUCING STRUCTURAL MEMBER OF ALUMINUM ALLOY

BACKGROUND OF THE INVENTION

1. Field of the Invention

The present invention relates to a process for producing a structural member of aluminum alloy, and particularly, to a process for producing a structural member of aluminum alloy by subjecting a powder preform of aluminum alloy powder to a heating treatment and then to a compacting and hardening process under a pressure.

2. Description of the Prior Art

There is such a conventionally known process for producing a structural member having a fine metallographic structure using an aluminum alloy powder having a non-equilibrium phase (for example, see Japanese Patent Application Laid-open No. 279767/93).

In the heating treatment in the known process, the rapid increase in temperature of the powder preform is conducted at an average temperature-increasing rate R equal to or higher than 333 K./min from room temperature to a forging temperature.

The reason why such a rapid increase in temperature is conducted is that the thermal hysteresis of the powder preform is decreased and hydrogen is rapidly released from the powder preform, so that the powder preform is veiled in hydrogen and thus prevented from being oxidized.

However, when an aluminum alloy powder having a non-equilibrium phase showing a calorific value C equal to or higher than 10 J/g at a temperature-increasing rate of 20 K./min in a differential scanning calorimetry is used for the purpose of further refining the metallographic structure of the structural member, if the rapid increase in temperature equivalent to that in the known process is conducted, a problem arises that the phase change is not uniformly conducted in the powder preform and, as a result, the produced structural member has an non-uniform metallographic structure and hence, has lower mechanical characteristics.

To solve this problem, it is necessary to lower the average temperature-increasing rate during the phase change down to a value lower than that in the known process. On the other hand, it is necessary to rapidly generate the releasing of hydrogen after the phase change and hence, it is desirable to increase the average temperature-increasing rate to correspond to this.

SUMMARY OF THE INVENTION

It is an object of the present invention to provide a process of the above-described type for producing a structural member using an aluminum alloy powder specified as described above, wherein a structural member having excellent mechanical characteristics can be produced by specifying the heating conditions.

To achieve the above object, according to the present invention, there is provided a process for producing a structural member of aluminum alloy by subjecting a powder preform of aluminum alloy powder to a heating treatment and then to a compacting and hardening process under a pressure, wherein the aluminum alloy powder used is an aluminum alloy powder having a non-equilibrium phase which shows a calorific value $C \geqq 10$ J/g at a temperature-increasing rate of 20 K./min in a differential scanning calorimetry, and in the heating treatment, an average temperature-increasing rate $R_2$ from Tx to Tx+A (wherein Tx (K.) represents a heat-generation starting temperature of the aluminum alloy powder, and $A \geqq 30$ K.) is $R_2 \leqq 60$ K./min, and the average temperature-increasing rate $R_4$ from Tw−B to Tw (wherein Tw (K.) represents a temperature in the compacting and hardening process, and $B \geqq 30$ K. and Tw−B>Tx+A) is $R_4 \geqq 60$ K./min.

The temperature range from Tx to Tx+A is a temperature range in which a non-equilibrium phase is changed. If the average temperature-increasing rate $R_2$ in this temperature range is set in the above-described range, the change of the non-equilibrium phase is uniformly performed, resulting in an uniformized metallographic structure of the produced structural member. It is desirable that the lower limit value for the average temperature-increasing rate $R_2$ is 20 K./min for inhibiting the coalescence of the metallographic structure of the structural member.

On the other hand, if the average temperature-increasing rate after the phase change is set in the above-described range, hydrogen can be rapidly released from the powder preform to reliably avoid oxidation of the powder preform. It is desirable that the upper limit value for the average temperature-increasing rate $R_4$ is 120 K./min for the reason that the non-uniformization of the temperature within the powder preform is prevented.

The above and other objects, features and advantages of the invention will become apparent from the following detailed description of a preferred embodiment taken in conjunction with the accompanying drawings.

DESCRIPTION OF THE PREFERRED EMBODIMENT

A molten metal having a composition of $Al_{91}Fe_6Ti_1Si_2$ (the unit of each of the numerical values is by atom %) was prepared, and using this molten metal, an aluminum allow powder was produced by utilizing an air atomizing process. Then, the aluminum alloy powder was subjected to a classifying treatment to provide an aluminum alloy powder having a particle size of at most 45 μm.

Figure 1:
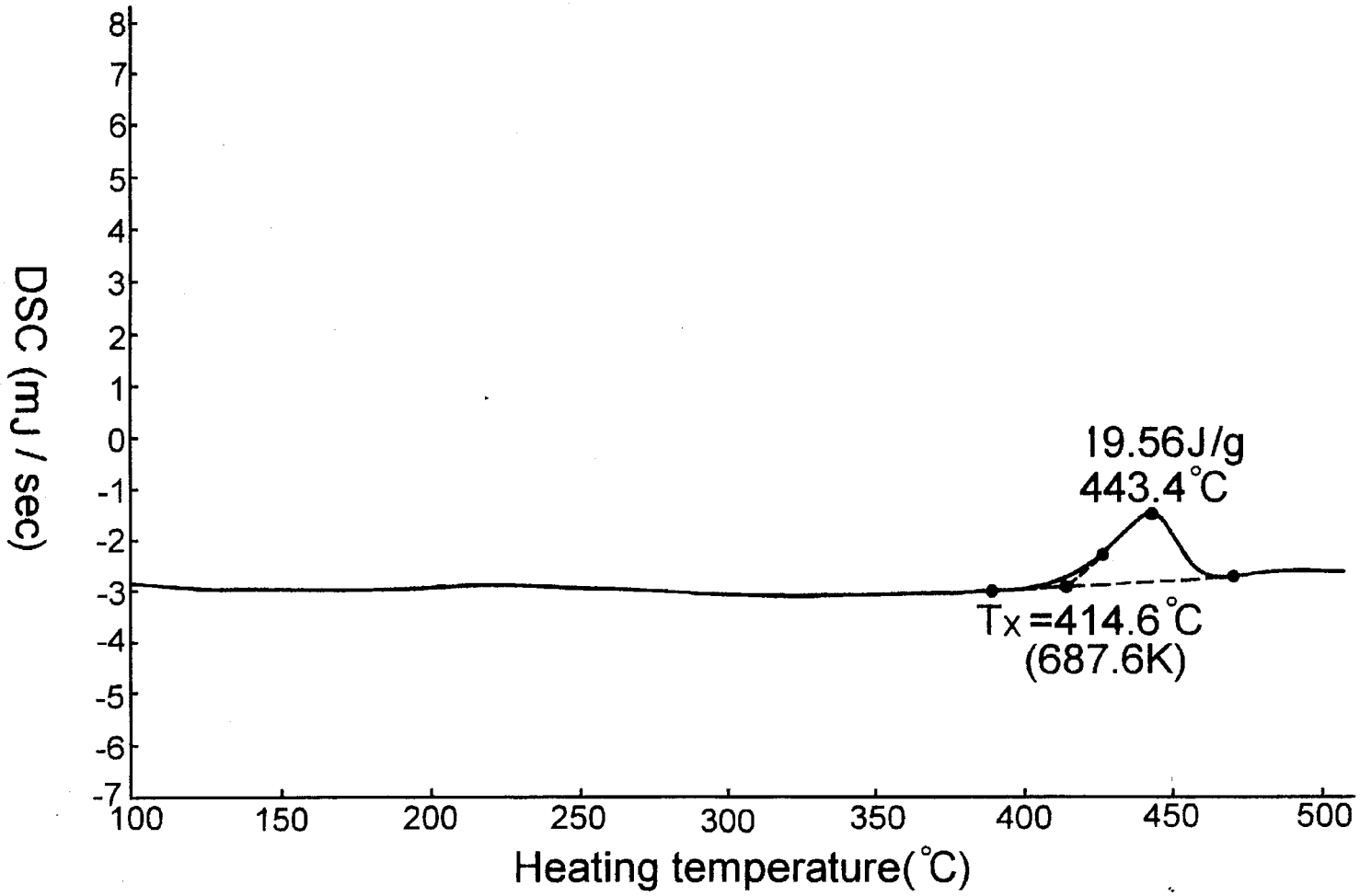
FIG. 1 is a graph showing results of a differential scanning calorimetry for an aluminum alloy powder.

The aluminum alloy powder was subjected to a differential scanning calorimetry (DSC). The result showed that the aluminum alloy had a non-equilibrium phase (a supersaturated solid solution) as shown in FIG. 1, which exhibited a calorific value C of 19.56 J/g at a temperature-increasing rate of 20 K./min and a heat-generation starting temperature Tx of 687.6° K. (414.6° C.).

EXAMPLE 1

Using the aluminum alloy powder, a plurality of powder preforms were formed. Then, these powder preforms were subjected to a heating treatment with an average temperature-increasing rate being varied in accordance with temperature ranges and then the powder preforms were subjected to a powder forging (compacting and hardening process) to produce a plurality of structural members.

The forming pressure for the powder preform was 600 MPa, and the powder preform has a diameter of 78 mm and a height of 20 mm. In the powder forging, the forging temperature (processing temperature) Tw was 823 K., and the forging pressure was 800 MPa. Further, the resultant structural member had a diameter of 80 mm and a height of 17 mm.

Figure 2:
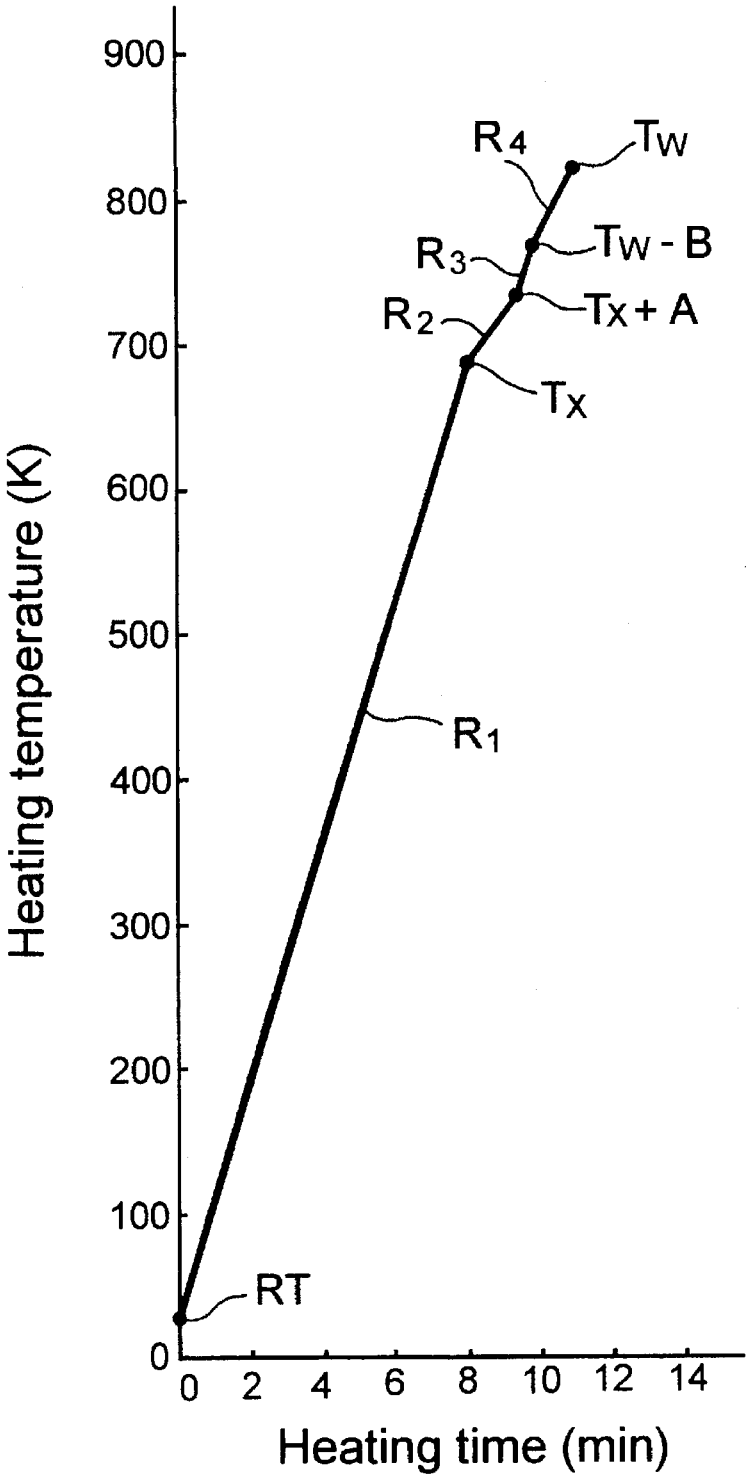
FIG. 2 is a graph showing one example of the relationship between the heating time and the heating temperature.

In the heating treatment, as shown in FIG. 2, the average temperature-increasing rate $R_1$ from room temperature RT to the heat-generation starting temperature Tx was controlled to 80 K./min; the average temperature-increasing rate $R_2$ from Tx to Tx+A (wherein A=30 K.) was controlled so that it was varied in a range of 40 K./min$\leqq R_2 \leqq$80 K./min; the average temperature rising rate $R_3$ from Tx+A to Tw−B (wherein B=30 K.) was controlled to 80 K./min, and the average temperature rising rate $R_4$ from Tw−B to Tw was controlled so that it was varied in a range of 40 K./min$\leqq R_4 \leqq$80 K./min.

Test pieces were fabricated from the structural members and subjected to a tensile test (at room temperature) and Charpy impact test to examine the relationship between the average temperature-rising rates $R_1$, $R_2$, $R_3$ and $R_4$ and the tensile strength, the elongation, as well as the Charpy impact value, thereby providing the results shown in Table 1.

TABLE 1

| Test piece No. | Average temperature-increasing rate (K/min); A = 30 K, B < 30 K: $R_1$ (RT to TX) | $R_2$ (Tx to Tx + A) | $R_3$ (TX + A to Tw − B | $R_4$ (Tw − B) to Tw) | Tensile strength (MPa) | Elongation (%) | Charpy impact value (J/cm$^2$) | Estimation |
|---|---|---|---|---|---|---|---|---|
| 1 | 80 | 80 | 80 | 75 | 512 | 2.1 | 9 | x |
| 2 | 80 | 70 | 80 | 75 | 518 | 2.4 | 10 | x |
| 3 | 80 | 60 | 80 | 75 | 580 | 6.0 | 18 | 0 |
| 4 | 80 | 50 | 80 | 75 | 576 | 5.9 | 17 | 0 |
| 5 | 80 | 40 | 80 | 75 | 581 | 6.0 | 19 | 0 |
| 6 | 80 | 50 | 80 | 80 | 589 | 6.1 | 18 | 0 |
| 7 | 80 | 50 | 80 | 70 | 580 | 6.2 | 19 | 0 |
| 8 | 80 | 50 | 80 | 60 | 572 | 6.0 | 20 | 0 |
| 9 | 80 | 50 | 80 | 50 | 481 | 1.0 | 7 | x |
| 10 | 80 | 50 | 80 | 40 | 476 | 0.8 | 7 | x |

As is apparent from Table 1, if the average temperature-increasing rate $R_2$ is set in a range of $R_2 \leqq 60$ K./min and the average temperature-rising rate $R_4$ is set in a range of $R_4 \geqq 60$ K./min at A=30 K. and B=30 K., the mechanical characteristics can be largely enhanced as with the test pieces Nos.3 to 8.

The reason why such an effect is obtained is believed to be as follows: The temperature range from the Tx to Tx+A is a temperature range in which the non-equilibrium phase is changed. If the average temperature-increasing rate $R_2$ in this temperature range is set in the above-described range, the change of non-equilibrium phase in the powder preform is performed uniformly and hence, the metallographic structure of the structural member is uniformized. If the average temperature-increasing rate $R_4$ after the phase change is set in the above-described range, hydrogen can be rapidly released from the powder preform and thus, the oxidation of the powder preform can be reliably avoided.

EXAMPLE 2

Using the above-described aluminum alloy powder, a plurality of powder preforms were formed. Then, these powder preforms were subjected to heating treatment with the average temperature-increasing rate being varied in accordance with the temperature ranges, and then the powder performs were subjected to a powder forging to produce a plurality of structural members.

The forming pressure for and the size of the powder preforms, the forging temperature Tw, the forging pressure in the powder forging, and the size of the structural members were the same as those in Example 1.

In the heating treatment, as shown in FIG. 2, the average temperature-increasing rate $R_1$ from RT to Tx was controlled so that it was varied in a range 30 K.$\leqq R_1 \leqq$100 K./min; the average temperature-increasing rate $R_2$ from Tx to Tx+A (wherein A=30 K.) was controlled to 50 K./min; the average temperature-increasing rate $R_3$ from Tx+A to Tw−B (wherein B=30 K.) was controlled so that it was varied in a range of 30 K./min$\leqq R_3 \leqq$100 K./min; and the average temperature-increasing rate $R_4$ from Tw−B to Tw was controlled to 80 K./min.

Test pieces were fabricated from the structural members and subjected to a tensile test (at room temperature) and Charpy impact test to determine the relationship between the average temperature-increasing rates $R_1$ and $R_3$ and the tensile strength, the elongation as well as the Charpy impact value, thereby providing results shown in Table 2.

TABLE 2

| Test piece No. | Average temperature-increasing rate (K/min); A = 30, B = 30 K: $R_1$ (RT to TX) | $R_3$ (Tx + A to Tx − B) | Tensile strength (MPa) | Elongation (%) | Charpy impact value (J/cm$^2$) |
|---|---|---|---|---|---|
| 1 | 100 | 80 | 579 | 6.0 | 18 |
| 2 | 70 | 80 | 583 | 5.8 | 17 |

TABLE 2-continued

| Test piece No. | Average temperature-increasing rate (K/min); A = 30, B = 30 K $R_1$ (RT to TX) | $R_3$ (Tx + A to Tx − B) | Tensile strength (MPa) | Elongation (%) | Charpy impact value (J/cm$^2$) |
|---|---|---|---|---|---|
| 3 | 50 | 80 | 580 | 6.1 | 18 |
| 4 | 30 | 80 | 581 | 5.9 | 18 |
| 5 | 80 | 100 | 589 | 5.9 | 17 |
| 6 | 80 | 70 | 580 | 6.1 | 19 |
| 7 | 80 | 50 | 571 | 6.4 | 20 |
| 8 | 80 | 30 | 561 | 7.0 | 24 |
| 9 | 100 | 100 | 594 | 5.7 | 16 |
| 10 | 30 | 30 | 560 | 7.0 | 25 |

As is apparent from Tables 1 and 2, it can be seen that if the average temperature-increasing rate $R_2$ is set in a range of $R_2 \leqq 60$ K./min (50 K./min in Table 2) and the average temperature-increasing rate $R_4$ is set in a range of $R_4 \geqq 60$ K./min (50 K./min in Table 2) at A=30 K. and B=30 K., the mechanical characteristics of the test pieces Nos. 1 to 10 in Table 2 are excellent even if the average temperature-increasing rates $R_1$ and $R_3$ are varied substantially and therefore, the average temperature-increasing rates $R_1$ and $R_3$ have very little influence on the mechanical characteristics of the structural members. However, if the average temperature-increasing rate $R_3$ is greatly reduced, there is a tendency that the strength of the test pieces is slightly reduced as with the test pieces Nos. 8 and 10 in Table 2, whereas the elongation is enhanced.

K.) was controlled to 50 K./min; the average temperature-increasing rate $R_3$ from Tx+A to Tw−B (wherein B was varied between 10 K. and 50 K.) was controlled to either 50 K./min or 80 K./min; and the average temperature-increasing rate $R_4$ from Tw−B to Tw was controlled to 100 K./min.

Test pieces were fabricated from the structural members and subjected to a tensile test (at room temperature) and Charpy impact test to determine the relationship between the average temperature-increasing rate $R_3$, Tx+A as well as Tw−B and the tensile strength, the elongation as well as the Charpy impact value, thereby providing results shown in Table 3.

TABLE 3

| Test piece No. | Tx + A (K) | Tw − B (K) | Average temperature-increasing rate $R_3$ (K/min) | Tensile strength (MPa) | Elongation (%) | Charpy impact value (J/cm$^2$) | Estimation |
|---|---|---|---|---|---|---|---|
| 1 | Tx + 10 | Tw − 30 | 80 | 510 | 2.1 | 10 | x |
| 2 | Tx + 20 | Tw − 30 | 80 | 511 | 2.3 | 11 | x |
| 3 | Tx + 30 | Tw − 30 | 80 | 581 | 6.1 | 18 | 0 |
| 4 | Tx + 40 | Tw − 30 | 80 | 579 | 6.3 | 19 | 0 |
| 5 | Tx + 50 | Tw − 30 | 80 | 578 | 6.2 | 18 | 0 |
| 6 | Tx + 30 | Tw − 10 | 50 | 471 | 1.2 | 6 | x |
| 7 | Tx + 30 | Tw − 20 | 50 | 474 | 1.0 | 7 | x |
| 8 | Tx + 30 | Tw − 30 | 50 | 583 | 6.0 | 18 | 0 |
| 9 | Tx + 30 | Tw − 40 | 50 | 585 | 5.8 | 16 | 0 |
| 10 | Tx + 30 | Tw − 50 | 50 | 589 | 5.9 | 16 | 0 |

EXAMPLE 3

Using the above-described aluminum alloy powder, a plurality of powder preforms were formed. Then, these powder preforms were subjected to a heating treatment with the average temperature-increasing rate being varied in accordance with the temperature ranges, and then the powder preforms were subjected to a powder forging to produce a plurality of structural members.

The forming pressure for and the size of the powder preforms, the forging temperature Tw, the forging pressure in the powder forging, and the size of the structural members were the same as those in Examples 1 and 2.

In the heating treatment, as shown in FIG. 2, the average temperature-increasing rate $R_1$ from RT to Tx was controlled to 100 K./min; the average temperature-increasing rate $R_2$ from Tx to Tx+A (wherein A was varied from 10 K. to 50

As is apparent from Table 3, if A in one transition point Tx+A is set at a value≧30 K., and B in the other transition point Tw−B is set at a value≧30 K. under conditions of an average temperatures increasing rate $R_2 \leqq 60$ K./min (i.e. 50 K./min.) and an average temperature-increasing rate $R_4 \leqq 60$ K./min (i.e. 100 K./min.), the mechanical characteristics of the test pieces can largely be enhanced as with the test pieces Nos.3 to 5 and 8 to 10.

EXAMPLE 4

Molten metals having various aluminum alloy compositions were prepared, and using these molten metals, aluminum allow powders were produced by utilizing an air atomizing process. Then, the aluminum alloy powders were subjected to a classifying treatment to provide aluminum alloy powders having a particle size of at most 45 μm.

Using the aluminum alloy powders, a plurality of powder preforms were formed. Then, these powder preforms were subjected to a heating treatment, and then to a powder forging to produce a plurality of structural members.

The forming pressure for and the size of the powder preforms, the forging temperature Tw, the forging pressure in the powder forging, and the size of the structural members were the same as those in Examples 1, 2 and 3.

Figure 3:
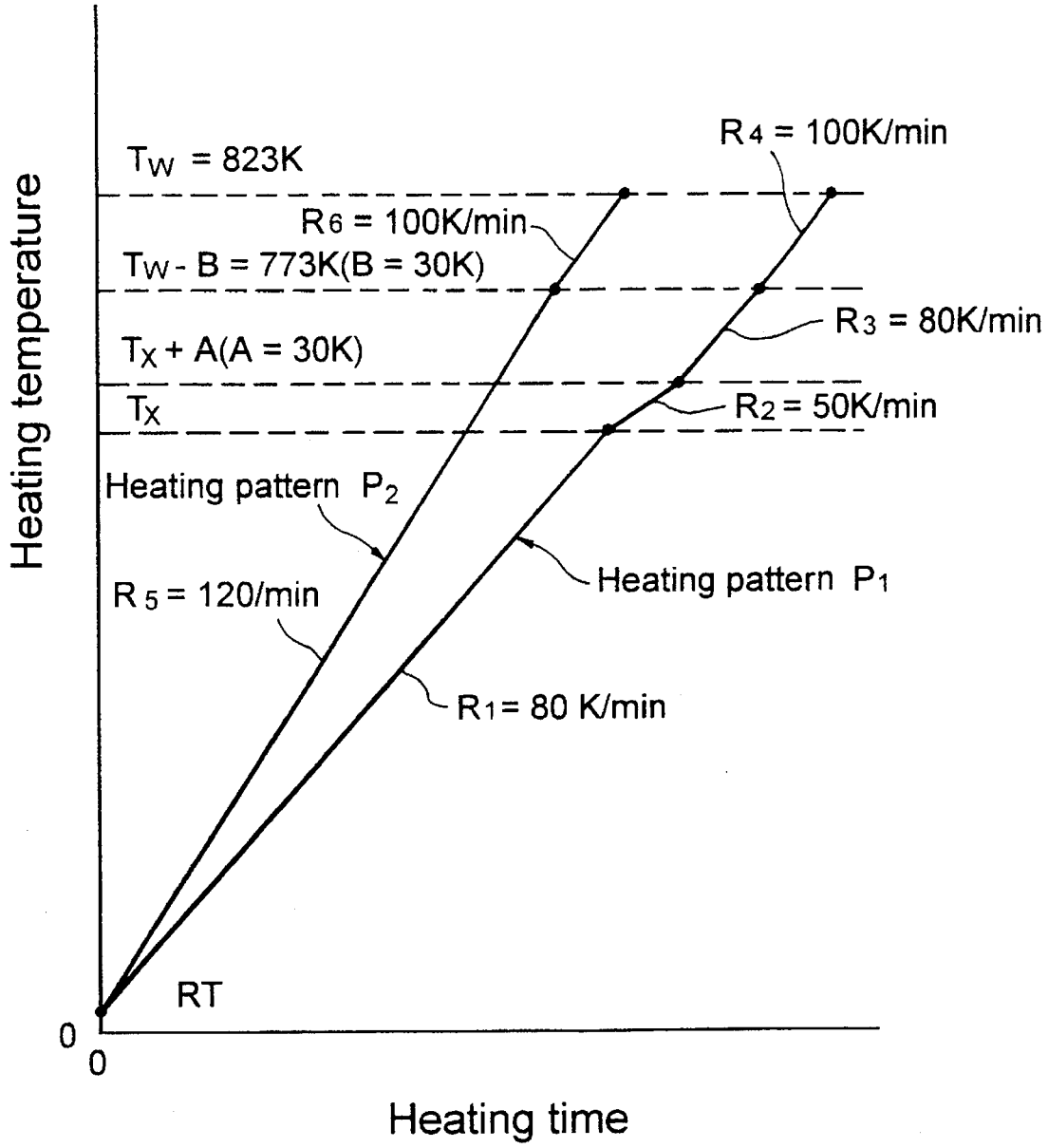
FIG. 3 is a graph showing another example of the relationship between the heating time and the heating temperature.

In the heating treatment, as shown in FIG. 3, two heating patterns $P_1$ and $P_2$ were employed. The heating patterns $P_1$ corresponds to an example of the present invention in which the average temperature-increasing rate $R_1$ from RT to Tx was controlled to 80 K./min; the average temperature-increasing rate $R_2$ from Tx to Tx+A (wherein A=30 K.) was controlled to 50 K./min; the average temperature-increasing rate $R_3$ from Tx+A to Tw–B (wherein B=30 K.) was controlled to 80 K./min; and the average temperature-increasing rate $R_4$ from Tw–B to Tw was controlled to 100 K./min. The other heating pattern $P_2$ corresponds to a comparative example in which the average temperature-increasing rate $R_5$ from RT to Tw–B was controlled to 120 K./min, and the average temperature-increasing rate $R_6$ from Tw–B to Tw was controlled to 100 K./min.

Test pieces were fabricated from the structural members and then subjected to a tensile test (at room temperature) and Charpy impact test.

Table 4 shows the composition, the calorific value C of the non-equilibrium phase at a temperature-increasing rate of 20 K./min and the heat-generation starting temperature Tx in a differential scanning calorimetry, the applied heating pattern, the tensile strength, the elongation and the Charpy impact value for the various test pieces.

TABLE 4

| Test piece No. | Composition (by atom %) | Calorific value C (J/g) | Heat-generation starting temperature Tx (K) | Heating pattern | Tensile strength (MPa) | Elongation (%) | Charpy impact value (J/cm$^2$) |
|---|---|---|---|---|---|---|---|
| 1 | $Al_{92}Fe_5Y_3$ | 52.3 | 625 | $P_1$ | 520 | 12.4 | 35 |
| 1a | | | | $P_2$ | 461 | 5.0 | 12 |
| 2 | $Al_{90}Fe_6Ti_2Si_2$ | 25.1 | 693 | $P_1$ | 591 | 7.2 | 18 |
| 2a | | | | $P_2$ | 483 | 3.1 | 9 |
| 3 | $Al_{91}Fe_6Zr_3$ | 18.0 | 678 | $P_1$ | 595 | 5.1 | 17 |
| 3a | | | | $P_2$ | 433 | 1.1 | 10 |
| 4 | $Al_{93}Fe_4Zr_1Si_2$ | 10.2 | 663 | $P_1$ | 520 | 9.8 | 21 |
| 4a | | | | $P_2$ | 448 | 3.4 | 11 |
| 5 | $Al_{93}Cr_4Fe_2Zr_1$ | 9.1 | 693 | $P_1$ | 448 | 4.9 | 11 |
| 5a | | | | $P_2$ | 444 | 4.8 | 11 |
| 6 | $Al_{94}Ni_2Fe_1Si_3$ | 0 | — | $P_1$ | 415 | 6.8 | 12 |
| 6a | | | | $P_2$ | 419 | 6.9 | 12 |

As is apparent from Table 4, if the heating pattern $P_1$ is employed when the aluminum alloy powder containing the non-equilibrium phase exhibiting the calorific value C equal to or more than 10 J/g is used, the mechanical characteristics of the test pieces can be largely enhanced as with the test piece Nos. 1 to 4.

If the heating pattern $P_2$ is employed when such aluminum alloy powder is used, the mechanical characteristics of the test pieces are reduced as with the test piece Nos. 1a to 4a.

When the calorific value C is smaller than 10 J/g, the mechanical characteristics of the test pieces are lower as with the test piece Nos. 5, 5a, 6 and 6a, irrespective of the heating patterns $P_1$ and $P_2$.

If the composition of the aluminum alloy is considered in view of the above-described results, it is believed that the desirable aluminum alloy powder is one having a composition which comprises Fe, at least one-alloy element AE selected from rare earth elements such as Y, Ti, Si and Zr, and the balance of aluminum with the content of Fe being in a range of 4 atom %≦Fe≦6 atom %, and the content of the alloy element AE being in a range of 3 atom %≦AE≦4 atom %. The present invention is applicable to the production of a structural member for an internal combustion engine, e.g., the production of a connecting rod.

What is claimed is:

1. A process for producing a structural member of aluminum alloy by subjecting a powder preform of aluminum alloy powder to a heating treatment and then to a compacting and hardening process under a pressure, wherein said aluminum alloy powder used is an aluminum alloy powder having a non-equilibrium phase which shows a calorific value C 6≧10 J/g at a temperature-increasing rate of 20 K./min in a differential scanning calorimetry/ and in said heating treatment, an average temperature-increasing rate $R_2$ from Tx to Tx+A (wherein Tx (K.) represents a heat-generation starting temperature of the aluminum alloy powder, and A≧30 K.) is $R_2$≦60 K./min, an average temperature-increasing rate $R_4$ from Tw–B to Tw (wherein Tw (K.) represents a temperature in said compacting and hardening process, and B≧30 K. and Tw B–Tx+A) is $R_4$≧60 K./min.

2. A process for producing a structural member of aluminum alloy according to claim 1, wherein said aluminum alloy powder comprises: Fe; at least one alloy element AE selected from rare earth elements, Ti, Si and Zr; and the balance of aluminum; and wherein the content of Fe is in a range of 4 atom %≦Fe≦6 atom %, and the content of said alloy element AE is in a range of 3 atom %≦AE≦4 atom %.

3. A process for producing a structural member of aluminum alloy by subjecting a powder preform of aluminum alloy powder to a heating treatment and then to a compacting and hardening process under a pressure, wherein said aluminum alloy powder has a non-equilibrium phase with a calorific value C above a predetermined amount, and said heating treatment including an average temperature-increasing rate from Tx to Tx+A (wherein Tx (K.) represents a heat-generation starting temperature of the aluminum alloy powder, and A≧30 K. that is sufficiently slow to be effective for a substantially uniform change in said non-equalitorium phase, and the average temperature-increasing rate from Tw−B to Tw (wherein Tw (K.) represents a temperature in said compacting and hardening process, and B≧30 K. and Tw−B>Tx+A) that is sufficiently fast to be effective for rapidly releasing hydrogen to inhibit oxidation.

4. A process for producing a structural member of aluminum alloy according to claim 3, wherein said aluminum alloy powder comprises: Fe; at least one alloy element AE selected from rare earth elements, Ti, Si and Zr; and the balance of aluminum; and wherein the content of Fe is in a range of 4 atom %≦Fe≦6 atom %, and the content of said alloy element AE is in a range of 3 atom %≦AE≦4 atom %.

5. A process for producing a structural member of aluminum alloy according to claim 3, wherein said temperature Tw is the highest temperature employed in said compacting and hardening process.

* * * * *

UNITED STATES PATENT AND TRADEMARK OFFICE

CERTIFICATE OF CORRECTION

PATENT NO. : 5,662,863
DATED : September 2, 1997
INVENTOR(S) : Okamoto et al.

It is certified that error appears in the above-identified patent and that said Letters Patent is hereby corrected as shown below:

Title page,
Item [56], under References Cited, change the reference "5,360,463 - 11/994" to read -- 5,306,463 - 4/1994 --.

Column 8,
Line 20, after "calorimetry" replace the slash with a comma -- , --.
Line 28, delete "Tw B - Tx+A" and replace it with -- Tw - B > Tx + A --.

Signed and Sealed this

Eighteenth Day of June, 2002

*Attest:*

*Attesting Officer*

JAMES E. ROGAN
*Director of the United States Patent and Trademark Office*